United States Patent [19]

Feron et al.

[11] 3,992,004

[45] Nov. 16, 1976

[54] SPRING BIASED THIGH AND PELVIC MUSCLE TONING APPARATUS

[76] Inventors: André Feron, 15 rue Jean Mermoz, 75008 Paris, France; Claude Bochurberg, 22-bis rue de La Reunion, 75020 Paris, France

[22] Filed: Dec. 30, 1974

[21] Appl. No.: 537,412

[30] Foreign Application Priority Data

Jan. 8, 1974 France ..... 74.00562

[52] U.S. Cl. ..... 272/141; 73/380; 272/134; 73/141 AB

[51] Int. Cl.[2] ..... A63B 21/00

[58] Field of Search ..... 272/83, 80, DIG. 4, 272/DIG. 5, 136–138, 140–142, 94, 126, 139, 134; 182/25, 57; 73/379, 380

[56] References Cited

UNITED STATES PATENTS

| | | | |
|---|---|---|---|
| 1,518,361 | 12/1924 | Ruden | 272/83 R |
| 1,548,849 | 8/1925 | Ruden | 272/83 R |
| 2,106,994 | 2/1938 | Chapman | 272/83 R |
| 2,132,862 | 10/1938 | Dilates | 272/83 R |
| 3,174,343 | 3/1965 | Kasulis | 272/DIG. 5 |

*Primary Examiner*—Richard C. Pinkham
*Assistant Examiner*—William R. Browne

[57] ABSTRACT

An apparatus for enabling the user to divaricate simultaneously his legs while overcoming or attempting to overcome an antagonistic resilient force constantly urging his legs towards each other without exceeding a predetermined amplitude comprises in combination two vertical bearing members between which the user can dispose his ankles and exert an outward pressure by use of the outer malleoli, adjustable resilient springs constantly tending to prevent the movement of said vertical bearing members away from each other, and adjustable stops for limiting the maximum horizontal movement of said vertical bearing members away from each other. A second stop member is provided to limit the movements of the bearing members toward each other. The bearing members are mounted on the ends of telescoping members. The bearing members are associated with graduated scales to show the extent of travel of the bearing members.

4 Claims, 4 Drawing Figures

IV
IV

SPRING BIASED THIGH AND PELVIC MUSCLE TONING APPARATUS

BACKGROUND OF THE INVENTION

The present invention relates to an apparatus for toning and strengthening the muscles of the thighs, pelvis and stomach. be harmony It is known that one of the methods prescribed for improving the tone and strength of muscles, notably the thigh and pelvic muscles, consists in reclining the patient completely with his legs stretched and joined together, and then compelling the patient to divaricate both legs simultaneously against a force constantly tending to move the legs towards each other, however without overstepping a predetermined amplitude which, in many cases, is subordinate to the width of the patient's pelvis. Of course, the force to be overcome must be adjustable to take due account of the patient's muscular system, so that it can be increased in harmony with the patient's progress.

SUMMARY OF THE INVENTION

It is the essential object of the present invention to provide an apparatus for improving the tone and strength of the thigh and pelvic muscles according to the method broadly set forth hereinabove, which may also be used in certain cases as a re-education apparatus, characterised in that is comprises to this end, in combination, two vertical bearing members between which the patient can place his ankles with the external malleoli contacting said members, adjustable elastic means constantly tending to prevent said vertical bearing members from moving away from each other, and other adjustable means for limiting the maximum relative distance between said vertical bearing members.

According to a preferred form of embodiment of this invention, the apparatus constituting the subject-matter thereof consists of a longitudinal member adapted to be laid on the floor and to constitute the frame structure of the apparatus, a pair of vertical bearing members adapted to slide on said longitudinal member, a stop member for limiting the movement of said vertical bearing members towards each other so that the patient can dispose his two ankles therebetween adjustable spring means engaging each one of said bearing members and constantly urging same towards each other to their inner positions, and other stop means limiting the permissible lateral sliding movement of each one of said bearing members in the outward direction.

If desired first graduated scale means may be provided for facilitating the adjustment of said pair of adjustable spring means, and other graduated scale means may be provided for adjusting the permissible maximum lateral sliding movement of each one of said bearing members.

Advantageously, said vertical bearing members may be rigidly assembled with horizontal plates slidably mounted on the longitudinal member constituting the frame structure of the apparatus, so as to keep said vertical bearing members in their vertical position and thus prevent on the one hand any detrimental deflection thereof under the thrust exerted thereon and on the other hand any tendency to jam.

BRIEF DESCRIPTION OF THE DRAWINGS

A typical form of embodiment of this invention is illustrated diagrammatically in the attached drawing, in which.

DESCRIPTION OF THE PREFERRED EMBODIMENT

Figures 1, 2, 3, 4:
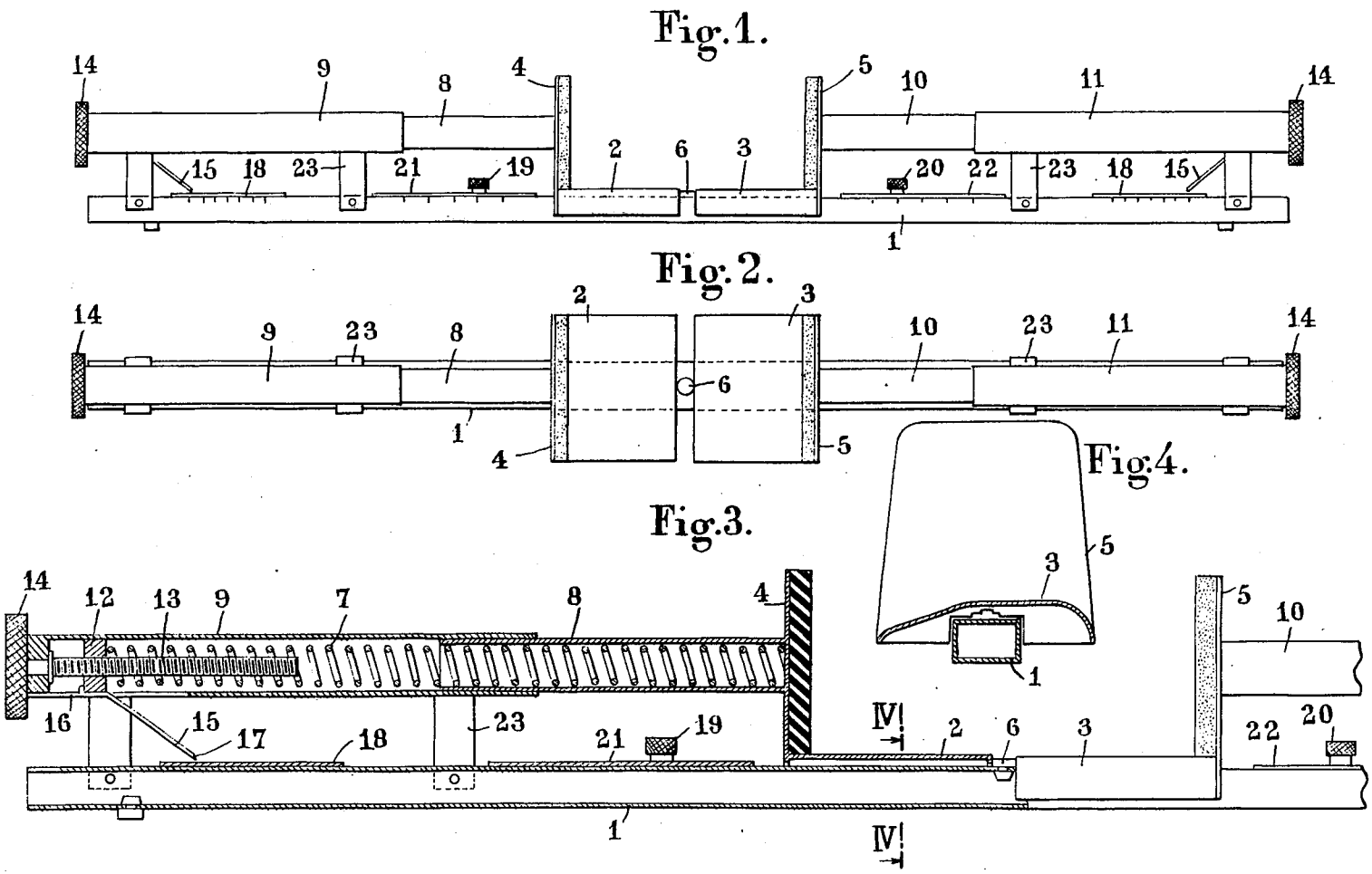
FIG. 1 is a side elevational view of the apparatus.
FIG. 2 is a plane view from above of the apparatus of FIG. 1.
FIG. 3 is a longitudinal section showing on a larger scale the left-hand portion of the apparatus.
FIG. 4 is a cross section taken along the line IV—IV of FIG. 3.

The apparatus illustrated comprises a longitudinal member 1 on which a pair of plates 2 and 3 rigid with vertical bearing members 4 and 5 are adapted to slide, a resilient stop 6 being provided between said plates 2 and 3.

These vertical bearing members are constantly urged towards each other by a pair of adjustable coil compression springs 7 enclosed in telescopic tubes 8, 9 (for one spring) and 10, 11 (for the other spring); these springs bear with one end against one of said vertical bearing members and with the other end against a nut 12 engaging a screw-threaded rod 13 rotatably rigid with an external knurled knob 14, said nut 12 being adapted to slide without rotating in the relevant tube (for example tube 9) so that when the knurled knob 14 is rotated together with the screw-threaded rod 13 rigid therewith, the nut will slide in one or the other direction according as it is rotated in one or another direction. To this end a lug 15 rigid with nut 12 extends through a longitudinal slot 16 formed to this end along a lower generatrix of tube 9, and the outer end 17 of said lug 15 registers with an underlying graduated scale 18 of which the division lines correspond to the degree of compression of spring 7. This lug 15, by engaging the edges of said slot 16, is sufficient for preventing the rotation of nut 12 rigid therewith when the screw-threaded rod 13 engaging said nut is rotated.

Stop members 19 and 20 adapted to be adjusted in the longitudinal direction limit the permissible lateral movements of said bearing members 4 and 5. These stop members 19 and 20 register likewise with graduated scales 21 and 22, respectively. The scales 18 corresponding to the tension of springs 7 may display an increment from left to right, as seen in the drawing, for the left-hand bearing member 4, and from right to left for the right-hand bearing member 5, respectively so as to correspond to increasing tension forces of the spring means. In contrast thereto, the scales 21 and 22 of stop members 19 and 20 may increase from right to left as far as the left-hand stop member 19 is concerned and from left to right for the right-hand stop member 20, and be such that when these stop members are disposed on front of division lines of the relevant scales which correspond to the same values or numerals, the latter indicate the maximum relative spacing obtainable between the vertical bearing members 4 and 5.

The fixed outer tubes 9 and 11 in which the telescopic tubes 8 and 10 are slidably fitted may be carried by brackets 23 having their bases secured to the longitudinal frame structure 1 of the apparatus, and the inner contour of plates 2 and 3 may correspond to the outer contour of the longitudinal member 1 in order to provide a reliable guiding action without any possibility of jamming the parts.

Of course, the form of embodiment of the invention which is depicted hereinabove and illustrated in the attached drawing should not be construed as limiting the invention since it is given by way of example only, considering the fact that many modifications and variations may be brought thereto without departing from the basic principles of the invention, as set forth in the appended claims. From the foregoing it is clear that there is described herein an apparatus enabling the users, especially women, to modify their complete muscular structure in the pelvic, thigh and stomach regions, and to trim their figure by acting on their cellulitis and more particularly on their buttocks.

What is claimed as new is:

1. Apparatus for improving the musculature of the thighs and pelvis by simultaneously divaricating the two legs of the previously stretched-out user lying on the floor, in opposition to a force constantly urging the legs towards each other, comprising, in combination an elongated base member adapted to be laid directly upon the floor and to constitute the lower frame structure of the apparatus, a user being postionable on a floor at right angles to said elongated member with his legs passing over said elongated member, a pair of spaced apart collapsible members rigidly mounted and disposed above and extending substantially parallel to said elongated base member, each said collapsible member having a pressure pad mounted thereon, each of said collapsible members having spring means mounted therein for biasing said pressure pads towards each other, stop means for limiting the movement of said pressure pads towards each other while under the biasing force of the spring means, so that a user can fit his or her two knees, feet or ankles therebetween in contact with said pressure pads, abutment means on the elongated base member for limiting the lateral sliding movement of each one of said pressure pads with respect to the elongated base member, and each said spring means having an adjustment means for varying the biasing force of the spring means.

2. Apparatus according to claim 1, in which said collapsible members are respective telescopic tubes, each said spring means acting on said pressure pads being mounted in a respective one of said telescopic tubes and reacts at one end against its associated pressure pad and at the opposite end against a nut engaging a screw-threaded rod rotatably solid with an external knurled knob, said nut being adapted to slide without rotating within its tube so that rotating said knurled knob and therefore the screw-threaded rod solid therewith will cause said nut to slide in one or the other direction according as said knob is rotated in one or the other direction, said nut with said rod and said knurled knob constituting at least part of said adjustment means.

3. Apparatus according to claim 2, wherein a lug rigid with each nut extends through a longitudinal slot at the lower portion of its tube, and the outer end of said lug is movable on a corresponding first graduated scale of which the division lines correspond to the momentary compression of the associated spring means.

4. Apparatus according to claim 3, wherein said abutment means comprises a plurality of longitudinally adjustable stop means each associated with a scale similar to said graduated scale.

* * * * *